United States Patent [19]

Tipper

[11] Patent Number: 4,587,980

[45] Date of Patent: May 13, 1986

[54] PORTABLE CIGARETTE HOLDER, EXTINGUISHER AND ASHTRAY

[75] Inventor: Frank Tipper, Richmond, Canada

[73] Assignee: Butti Pocket Ashtray Company, Ltd., Surrey, Canada

[21] Appl. No.: 629,485

[22] Filed: Jul. 10, 1984

[51] Int. Cl.[4] ..... A24F 13/18; A24F 13/20; A24F 19/14

[52] U.S. Cl. ..... 131/235.1; 131/256

[58] Field of Search ..... 131/257, 256, 235 R, 131/256, 235.1, 237, 238; D27/8, 9, 15

[56] References Cited

U.S. PATENT DOCUMENTS

| | | | |
|---|---|---|---|
| 1,904,084 | 4/1933 | Riley | 131/235 R |
| 2,113,745 | 4/1938 | Pyatt | 131/235 R |
| 2,715,961 | 8/1955 | Field | 131/256 |

*Primary Examiner*—V. Millin

*Attorney, Agent, or Firm*—Pretty, Schroeder, Brueggemann & Clark

[57] ABSTRACT

A novel portable cigarette holder, extinguisher and ashtray which is capable of fitting in the pocket, purse or handbag of a smoker. The holder-ashtray has a restricted internal throat which encircles the sides of a lighted cigarette butt inserted in the holder-ashtray and smothers the cigarette. The entrance to the holder-ashtray is flared to enhance entry of the lighted end of the cigarette into the holder-ashtray. The interior of the holder-ashtray is gradually flared away from the throat to encourage the cigarette butt to drop into the interior of the holder-ashtray. When inverted, the holder-ashtray retains the cigarette butt against the throat which acts as a stopper and prevents ashes falling out.

5 Claims, 4 Drawing Figures

PORTABLE CIGARETTE HOLDER, EXTINGUISHER AND ASHTRAY

FIELD OF THE INVENTION

This invention is directed to a novel portable cigarette holder, extinguisher and ashtray which is capable of fitting in the pocket, purse or handbag of a smoker.

BACKGROUND OF THE INVENTION

A continuing problem which faces cigarette smokers is that ashtrays for disposal of ashes from a lighted cigarette and disposal of cigarette butts after the smoker is finished smoking the cigarette are not always readily available. This is a particular problem indoors where because of public and health authorities pressure to discourage smoking, many households and public places do not have ashtrays. Thus, those smokers who encounter such situations, or persist in smoking, or cannot overcome their addiction to cigarettes, face a continuing problem in disposing their ashes and cigarette butts.

Another problem is that lighted cigarettes represent a continuing fire hazard, both indoors and outdoors. Cigarettes which have not been extinguished have been known to be the cause of homes being destroyed by fire, including loss of lives, and brush and forest fires. Thus, there is a longstanding need for a lightweight, portable, readily available device which can readily, quickly and safely extinguish a cigarette.

Yet another continuing problem with smokers is that in many public places and vehicles such as airports, railway and bus stations, airplanes, trains and buses, cigarettes must be extinguished before the smoker is finished with the cigarette. Also, at dinners and the like, some people like to smoke before or during courses. Thus, large size cigarette butts must be discarded. It would be advantageous if such large size cigarette butts could be kept in good condition and relit at a subsequent convenient opportunity. This would represent a substantial saving because a fresh cigarette would not be required each time a smoker wished to smoke.

In the past, many innovators have invented or designed portable type ashtrays as a covenience to smokers. To date such portable ashtrays have not received widespread commercial or consummer acceptance due to a number of shortcomings inherent in the ashtrays that have been designed.

The inventor is aware of the following United States patents which disclose portable ashtrays of various designs:

| U.S. Pat. No. | Inventor | Issue Date |
|---|---|---|
| Des 101,312 | H. E. Ridewood | Sep. 22, 1936 |
| 2,113,745 | V. M. Pyatt | Apr. 12, 1938 |
| 2,536,302 | L. Mertzel | Jan. 3, 1951 |
| 2,715,961 | W. R. Field | Aug. 23, 1955 |
| 2,760,498 | G. W. McVey | Aug. 28, 1956 |
| 2,781,762 | M. H. Mears | Feb. 19, 1957 |
| 2,964,044 | W. M. Bryan | Dec. 13, 1960 |
| 3,107,674 | G. A. Smith | Oct. 22, 1963 |
| 3,375,832 | L. E. McMichael | Apr. 2, 1968 |
| 3,405,719 | S. Lustbader | Oct. 15, 1968 |

SUMMARY OF THE INVENTION

I have invented a convenient, useful, lightweight, sturdy, readily portable, safe cigarette holder, extinguisher and ashtray which can be carried by a smoker and stored in a pocket such as a shirt or coat pocket, of the clothing worn by the smoker or a purse or handbag carried by the smoker. The holder-ashtray can be conveniently carried indoors or outdoors. The portable holder-ashtray is designed to accept standard diameter machine made cigarettes, including king size and filter cigarettes, and extinguishes the lighted cigarette in a very few seconds. Even if the butt remains lit for some inexplicable reason, the lighted cigarette cannot contact anything to thereby cause a fire. This provides a strong safety feature for the novel holder-ashtray which has not so far as is known been achieved by portable ashtrays known in the art.

The holder-ashtray, when inverted, does not permit the cigarette butt, or the ashes to spill out, because the cigarette butt acts as a stopper against the throat inside the holder-ashtray. The holder-ashtray, by smothering the cigarette butts, leaves the butts in good condition so that they can be relit at some later time without encountering any disagreeable "butt-taste".

The invention is directed to a portable holder-ashtray which is capable of receiving the lighted end of at least one lighted cigarette butt, comprising: (a) a chamber for receiving and holding the cigarette butt; (b) an opening into the chamber for admitting the lighted cigarette butt into the chamber; and, (c) a restriction between the chamber and the opening which encircles the sides of the lighted cigarette butt as it is admitted into the chamber and smothers the lighted end of the cigarette butt by preventing sufficient sustaining oxygen to enter the chamber when the butt is in place in the restriction. By smothering the cigarette, the butt is retained in good condition unlike cases where the butt is crushed against an ashtray.

In the ashtray, the chamber may be cylindrical and elongated in shape and the restriction may be circular in shape. The cylindrical chamber may be of gradual increasing internal diameter in the direction away from the opening so that the cigarette butt does not contact the walls of the chamber. This is advantageous because the extinguished cigarette butt remains in good condition and does not have ashes or tar rubbed against its sides.

In the holder-ashtray, the opening into the chamber may be flared in a direction away from the restriction. This enables the opening to be used as an ashtray for receiving ashes flicked off the end of the lighted cigarette. A removable cap may be located at the end of the chamber opposite the opening. This feature permits the extinguished butt to be readily removed for disposal and holder-ashtray to be cleaned.

DRAWINGS

In the drawings, which illustrate one design of the portable ashtray:

DETAILED DESCRIPTION OF ONE EMBODIMENT OF THE INVENTION

Figure 1:
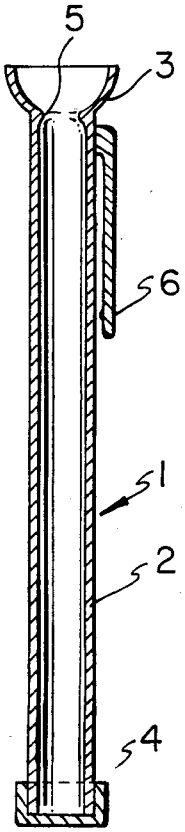
FIG. 1 represents a side elevation view of the portable ashtray.
Figure 2:
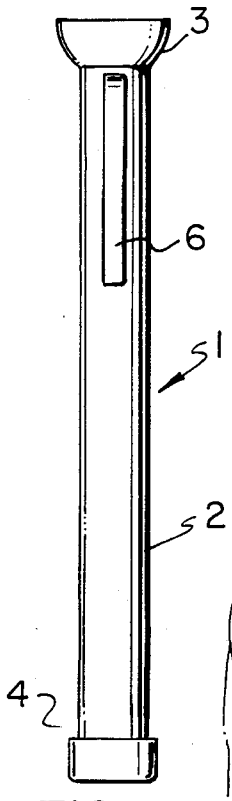
FIG. 2 represents a front elevation view of the portable ashtray.
Figure 3:
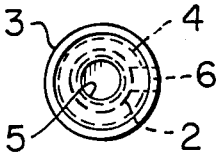
FIG. 3 represents a top elevation view of the portable ashtray.
Figure 4:
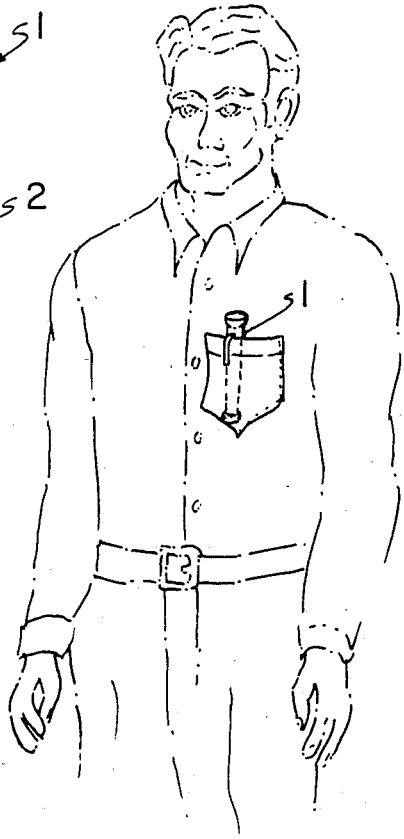
FIG. 4 represents a perspective view of the portable ashtray held in a shirt pocket of a user.

As can be seen in FIG. 1, the portable holder-ashtray 1 is of an elongated shape, comprising a cylindrical barrel 2, with a flared mouth 3 at one end and a removable cap 4 at the opposite end. A throat 5 of restricted diameter is located at the base of the mouth 3 where it joins the barrel 2. The barrel 2 is equipped with a clip 6 which is useful for clipping and holding the holder-ashtray 1 upright rn a shirt (see FIG. 4) or jacket pocket. Alternatively, the holder-ashtray 1, with or without the clip 6, may be kept in a purse or handbag of the smoker.

The holder-ashtray 1 can be formed of suitable metal, such as polished or chrome plated steel or stainless steel, or extrusion molded of a suitable fire resistant thermosetting plastic such as a phenolic or ureaformaldehyde resin. The clip 6 may be formed of metal or plastic, so long as it is a material which can exert a slight tension force on the clip 6 when the ashtray 1 is placed in a pocket.

The geometrical design of the ashtray has a number of important features which contribute to the utility and safety of the holder-ashtray 1. The mouth 3 is curved and flared outwardly away from the barrel 2 to assist entry of the lighted end of the cigarette into the interior of the barrel 2. The curved flared shape enables the mouth 3 to be used as an ashtray when the smoker wishes to flick ashes off the end of the lighted cigarette into the mouth 3. The curved shape of the mouth 3 permits a finger-tip to fit within the mouth 3, thereby assisting the procedure of pushing the cigarette through the throat 5. Further, the flared mouth 3 ensures that ashes, either lighted or dead, do not contact the clothing of the smoker or ashtray carrier.

The diameter of the throat 5 is restricted relative to the internal diameter of the barrel 2 and is specifically designed to snuggly accommodate the diameter of virtually all machine-made cigarettes available in the marketplace. Moreover, the fit of the throat 5 about the circumference of the cigarettes in combination with the fact that the barrel 2 is completely enclosed, extinguishes the lighted end of the cigarette in about six to eight seconds. The fit of the throat 5 on the cigarette circumference is sufficiently snug that oxygen is prevented from reaching the lighted end of the cigarette once it has been inserted past the mouth 3 into the interior of the barrel 2. Indeed, it has been found that even if cap 4 is removed, the cigarette is extinguished, clearly, not enough oxygen reaches the cigarette to enable it to remain lit. The rapid smothering action represents an important safety feature because it ensures that a lighted cigarette will not remain in the shirt pocket of the smoker or a handbag or purse, thereby creating a potential fire hazard by setting fire to the handbag, purse or clothing of the smoker or generating a hot spot which might burn the smoker by being conducted through the wall of the barrel 2 and the shirt of the smoker. Also the throat 5 prevents the cigarette butt from falling out of the holder-ashtray 1 if the holder-ashtray 1 is inverted, such as might occur if the smoker bends over, or if the holder-ashtray 1 is dropped on an inflamable material such as a carpet, upholstery, dry grass or a forest floor.

The barrel 2 is constructed so that its internal diameter increases gradually in a direction away from the throat 5 towards the cap 4. Thus, once a lighted cigarette is inserted into the barrel 2, the lighted ash before being extinguished does not tend to contact the interior walls of the barrel 2. Thus, smothered butts do not have ash or tar smeared on the sides and the butts can be removed and relit by the smoker. It has been found that the extinguished butts taken out of the holder-ashtray 1, when relit, do not have a disagreeable "butt taste" which is normally the case when butts extinguished in conventional ashtrays are relit. Also, the slight internal taper of the barrel 2 encourages the cigarette butt to drop into the interior of the barrel 2 after it is extinguished. The length of the barrel 2 is designed to be of sufficient length that it will receive two or three cigarette butts. At the same time the length of the barrel 2 should be sufficiently short that it will be comfortably received in a normal shirt or suit jacket pocket, or a handbag or purse.

When it is required to empty the holder-ashtray 1, cap 4 is unscrewed and the cigarett butts and ashes are removed. The interior of the barrel 2 and the mouth 3 can then be cleaned with a cloth or tissue, or if desired, washed in water.

EXAMPLE 1

A number of tests with various commercially available cigarettes were conducted using a prototype of the following dimensions.

Length—5 inches
Length from base to throat—4.438 inches
Diameter of mouth—0.32 inches
Diameter of throat—0.305 inches
Diameter of base—0.33 inches Commercially available cigarettes used for testing included Du Maurier (filter), Player's, Export, and Craven A (filter). It was found that each of these brand name cigarettes passed smoothly and snuggly past the throat and were held snuggly by the throat if not inserted entirely into the chamber of the holder-ashtray. If the cigarettes were pushed all the way past the throat, the cigarettes fell freely into the interior of the chamber. When the cigarette was inserted partially into the holder-ashtray, it could be withdrawn easily. Moreover, when the holder-ashtray was inverted with a cigarette contained in the chamber, the cigarette did not fall out.

EXAMPLE 2

Using a holder-ashtray as described in example 1, a lighted Du Maurier cigarette was inserted all the way into the chamber of the holder-ashtray. The holder-ashtray was then dropped on a carpet. Neither the lighted cigarette nor any sparks came out of the holder-ashtray.

EXAMPLE 3

Using a prototype as described in example 1, a lighted Du Maurier cigarette was inserted into the holder-ashtray. Only a slight warming sensation was felt at the exterior of the barrel of the holder-ashtray. No hot spot was generated.

EXAMPLE 4

Using the same prototype as defined in example 1, a lighted Player's cigarette was inserted into the barrel of the holder-ashtray, the holder-ashtray was inverted, and shaken. Neither the cigarette nor any lighted ash came out of the holder-ashtray.

EXAMPLE 5

A series of time tests were done using the prototype described in example 1. Lighted Craven A cigarettes were inserted into the throat of the holder-ashtray for periods of time ranging from 4 seconds through to 8 seconds, where upon the cigarette in each instance was withrawn. It was found that the cigarettes which had been inserted into the holder-ashtray for periods of 6, 7 or 8 seconds, had been entirely extinguished. It was not possible to relight those cigarettes by drawing on the cigarette. The cigarettes which had been inserted into the holder-ashtray for 4 and 5 seconds respectively, while almost extinguished, could be regenerated by drawing on the cigarettes.

EXAMPLE 6

The cap was removed from a prototype as described in example 1. A lighted Export cigarette was partially inserted into the holder-ashtray and it was found that even with the cap removed, the cigarette was extinguished in 6 seconds. When the cigarette was withdrawn from the holder-ashtray, the end of the cigarette was crushed between the fingers, but no heat was encountered.

EXAMPLE 7

Four experienced smokers relit cigarettes which had been extinguished using the holder-ashtray. None noticed any conventional "butt-aftertaste" when relighting the cigarettes. Moreover, no "butt-aftertaste" was encountered even though the cigarettes were extinguished and relit a number of times.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A portable cigarette extinguisher-holder-ashtray suitable for being carried in the pocket of a cigarette smoker and capable of receiving the lighted end of a cigarette butt comprising:

(a) a generally enclosed chamber with an opening therein for receiving and holding a cigarette butt, the width of the chamber being slightly larger in size than the diameter of a conventional cigarette, and the width of the chamber gradually increasing in the direction away from the opening; and (b) a restriction throat, between the chamber and the opening which encircles the sides of the lighted cigarette butt as it is admitted into the chamber and is adapted to smother the lighted end of the cigarette butt by preventing combustion sustaining oxygen from reaching the lighted end of the cigarette.

2. An ashtray as defined in claim 1 wherein the chamber is cylindrical and elongated in shape and the restriction throat is circular in shape.

3. An ashtray as defined in claim 1 wherein the opening into the chamber is flared in a direction away from the restriction.

4. An ashtray as defined in claim 2 wherein a removable cap is located at the end of the chamber opposite the opening.

5. An ashtray as defined in claim 3 wherein the opening is convex in shape.

* * * * *